United States Patent [19]

Tamaki

[11] Patent Number: 5,021,095

[45] Date of Patent: Jun. 4, 1991

[54] PROCESS FOR REMOVING ASBESTOS AND THE DEVICE FOR REMOVING THE SAME

[75] Inventor: Masaru Tamaki, Satomimachi, Japan

[73] Assignee: Hokkaido Pipeline Industrial Co., Ltd., Sapporo, Japan

[21] Appl. No.: 302,574

[22] Filed: Jan. 25, 1989

[51] Int. Cl.[5] ..... B08B 5/04

[52] U.S. Cl. ..... 134/21; 134/15; 134/26; 134/43; 134/54; 15/308; 15/320; 15/321; 299/64

[58] Field of Search ..... 15/362, 81, 382, 93 R, 15/344, 345, 398, 347, 400, 383, 93 C, 22 R, 23; 261/DIG. 9; 299/64, 18; 55/127, 204; 134/25.1, 25.4, 26, 21, 42

[56] References Cited

U.S. PATENT DOCUMENTS

| | | | |
|---|---|---|---|
| 3,343,198 | 10/1974 | Reynolds | 299/18 |
| 4,274,676 | 6/1981 | Chapel | 299/64 |
| 4,344,920 | 8/1982 | Isserlis | 261/DIG. 9 |
| 4,438,977 | 3/1984 | Chapel | 299/64 |
| 4,626,291 | 12/1986 | Natale | 134/21 |
| 4,809,391 | 3/1989 | Soldatovic | 15/301 |
| 4,817,644 | 4/1989 | Holmes et al. | 15/382 |
| 4,872,920 | 10/1989 | Flyn et al. | 15/321 |
| 4,923,251 | 5/1990 | Funakawa et al. | 15/308 |

*Primary Examiner*—Anthony McFarlane
*Attorney, Agent, or Firm*—Dilworth & Barrese

[57] ABSTRACT

A process and device for removing a sprayed asbestos layer are provided, in which the asbestos is simultaneously cut and suctioned by a scraper and a suction air duct, and then transported into a carrier container for collection through primary, secondary and tertiary collection steps, in order to maintain a safe and sanitary operational environment for those who are engaged in removing the asbestos layer.

6 Claims, 5 Drawing Sheets

PROCESS FOR REMOVING ASBESTOS AND THE DEVICE FOR REMOVING THE SAME

BACKGROUND OF THE INVENTION

The present invention relates to a process and device for removing an object to be cut. More particularly, the invention relates to a process for collecting an asbestos layer by suction and simultaneously cutting the same, and further carrying the asbestos to a carrier container in order to maintain a sanitary and safe operational environment for individuals engaging in removing the asbestos layer. In removing the asbestos layer, dust and waste generated exert a bad influence upon the human body,.which causes serious problems.

Previously, in removing the sprayed asbestos, a work field for removing the asbestos was closely covered with a vinyl sheet in order to prevent scattering of asbestos dust. Additional load was applied to the inside thereof. Thereafter, the asbestos was scraped onto a floor by means of a scraper, brush and large aspirator for use, while spraying or sprinkling water or wetting material thereon in order to reduce the fugacity of the asbestos thus cut. Therefore, according to the conventional removing process of the asbestos, asbestos dust hangs over the work field, which caused a considerably poor operational environment. Furthermore, in employing the large aspirator, scraping and suctioning of the asbestos layer were separately carried out, complicating the operation while suspended dust density within the work field increased. As a result, a worker or any other person standing in the vicinity of said worker was thereby adversely affected. Furthermore, since no apertures in the shape of a window are perforated in the wall surface of an attachment connected to the conventional aspirator through a hose, it is difficult to easily move or shift the face of said attachment due to close suction of a suction inlet onto the wall surface.

SUMMARY OF THE INVENTION

With the above in mind, it is an object of the present invention to provide a process for collecting sprayed asbestos by suction simultaneously with cutting the same, and further carrying the asbestos thus cut to a carrier container in order to maintain the safe and sanitary operation environment of those who are engaging in removing the asbestos.

Another object of the present invention is to provide a device for carrying out said process with an improved attachment of said device.

The aforementioned objects can be attained by a process comprising a sprayed asbestos layer being cut and suctioned simultaneously therewith by means of a scraper and a suction air duct, the asbestos thus suctioned being led into a collector through a closed conduit to collect said asbestos dust within water as a primary collecting process. A secondary collecting process is carried out by means of a wet type cyclone and by showering the air passing through said collector. Then, a tertiary collecting process is carried out to collect the air passing through the secondary process by means of a compound filter. A device is employed comprising an attachment consisting of a scraper integrally formed with a suction air duct provided with a plurality of apertures in the shape of a window perforated therein and a suction inlet. A closed conduit for carrying the asbestos dust thus suctioned is connected to said air duct through a hose, a collector, a wet type cyclone and a scrubber connected to each other within said closed conduit. A compound filter is disposed at a final position of said closed conduit.

As described above, according to the present invention, it becomes possible to suction the asbestos dust generated from cutting the asbestos layer by means of a suction air duct without scattering or dropping said dust. A collector can collect the suctioned asbestos together with the dust thereof and at the same time can dampen the same in order to prevent the asbestos from scattering in a further process. The wet type cyclone and scrubber can collect a fine asbestos dust which is rather difficult to collect by means of a primary collector. In order to enhance the collecting function of said cyclone and scrubber, a shower ring is supplementally provided. A compound filter can finally remove a fine asbestos dust which can not be collected by means of said cyclone and scrubber and then exhausts.

It is further possible to scrape the asbestos layer by means of a scraper integrally formed with the suction air duct while pressing a suction inlet thereof against a ceiling or wall surface. Since apertures in the shape of a window are perforated in said air duct, it is possible to suction air through the apertures, thereby facilitating the face shift of said suction inlet along the ceiling or wall surface and further suction asbestos dust floating outside of the suction duct thereinto.

BRIEF DESCRIPTION OF THE DRAWINGS

In the Figures.

DESCRIPTION OF THE PREFERRED EMBODIMENTS

Figure 1:
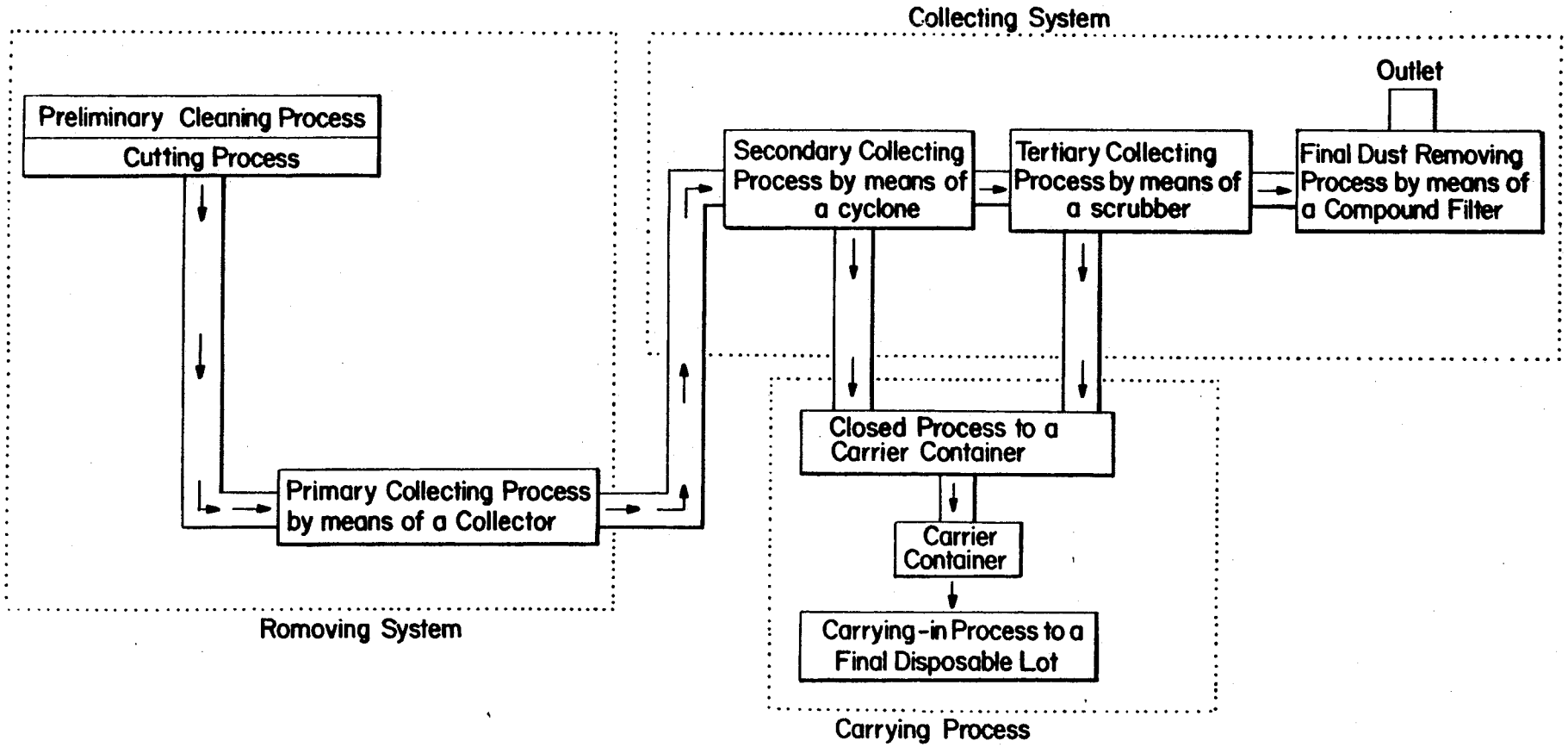
FIG. 1 is a flow chart showing the process according to the present invention.

Hereinafter, embodiments according to the present invention will be described in detail with reference to the drawings.

FIG. 4 to FIG. 7 illustrate embodiments according to the present invention in which an attachment (a) is applied to the device of the invention. Said attachment consists of a scraper 1, a suction inlet 17, a suction air duct 2, and apertures 15 in the shape of a window perforated in said air duct which is connected to a hose 9.

In FIGS. 1–7, the scraper 1 is projectingly formed at an upper end of the air duct 2 in the shape of a cutter. An asbestos layer A is scraped by means of the scraper by pressing the suction inlet 17 of said air duct 2 against a ceiling or wall surface. The asbestos thus scraped is collected into a collector 4 through the hose 9. Since the apertures 15 are perforated in the air duct at a prescribed position in the vicinity of the suction inlet 17, surrounding air and floating asbestos can be suctioned into the air duct through said apertures 15. Accordingly, it is possible to avoid shifting difficulty of the air duct due to the close suction onto the ceiling or wall surface of a building.

Figure 2:
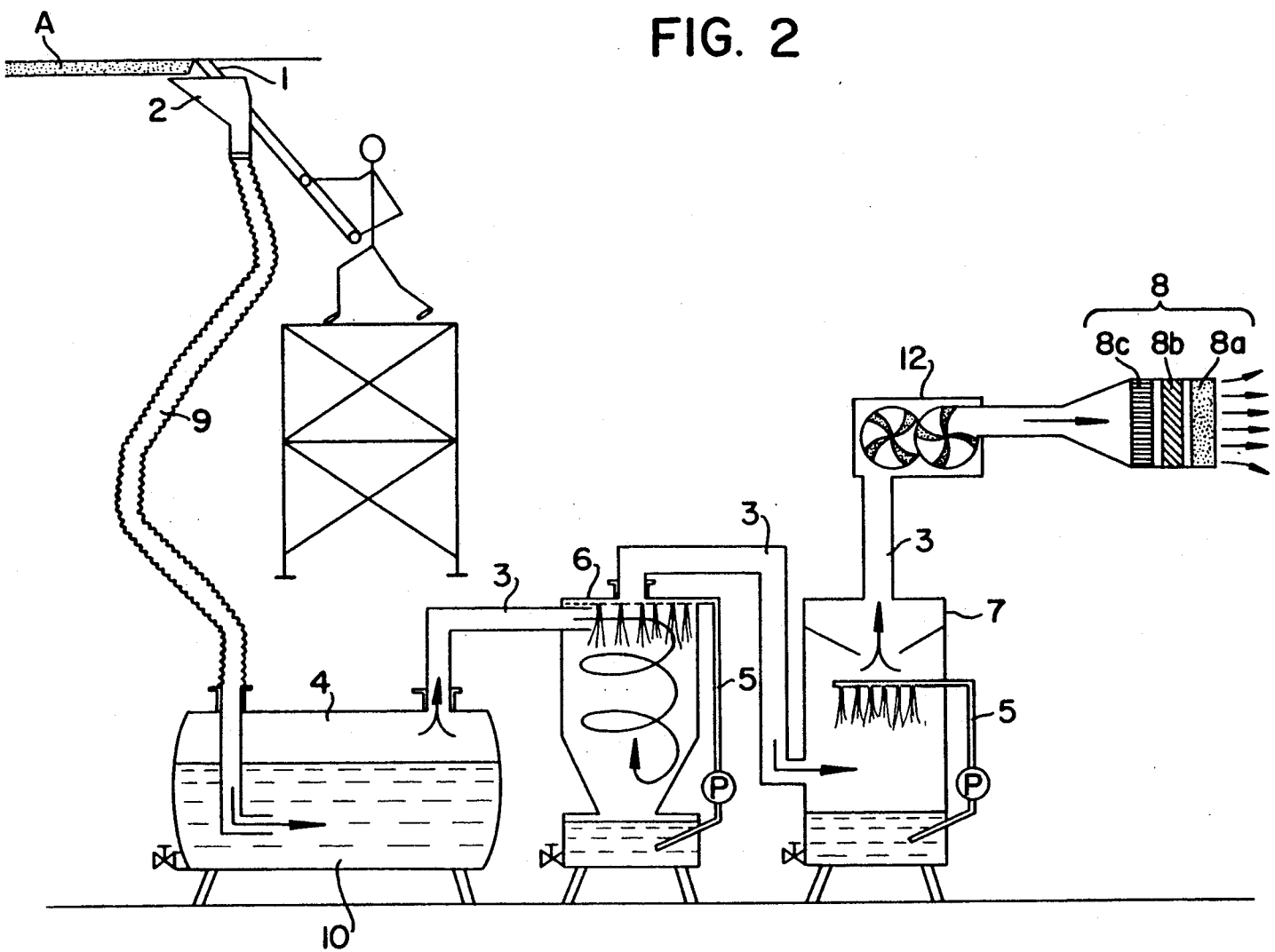
FIG. 2 is a front view of the device according to the present invention.

In FIG. 2, an upper end of the scraper 1 is bent upwardly in the shape of a cutter and the asbestos layer is scraped by means of said scraper by positioning the air duct 17 directly below said scraper while pressing the same against the ceiling, etc.

Figure 6:
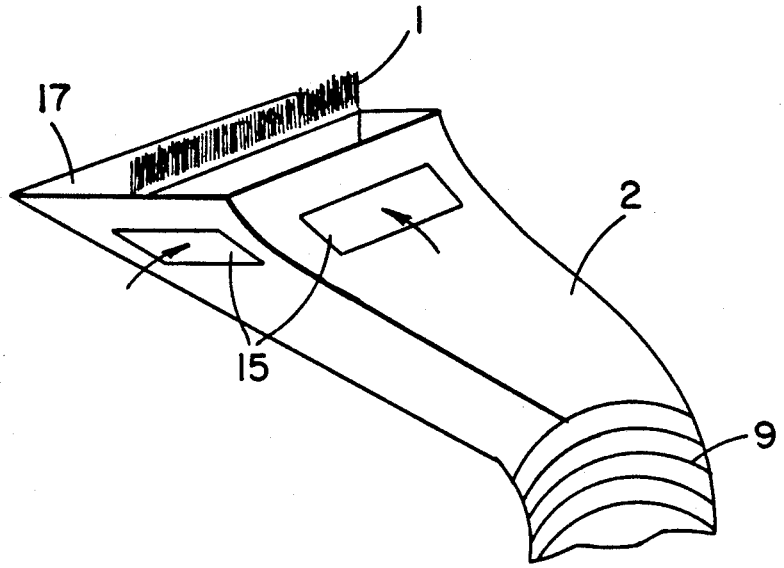
FIG. 6 is a perspective view of a third embodiment of an attachment applied to the device according to the present invention.
Figure 7:
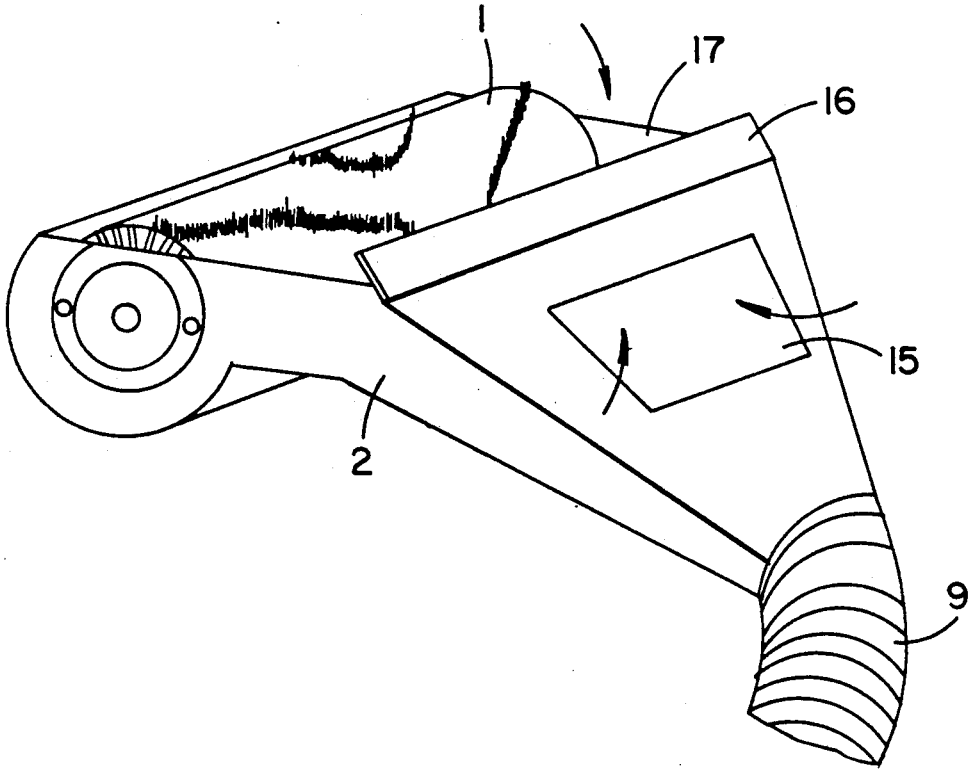
FIG. 7 is a perspective view of a fourth embodiment of an attachment applied to the device according to the present invention.

In FIG. 6, a brush is mounted inside the air inlet 17 and in FIG. 7, a rotary electric brush is mounted inside the air inlet 17, which are other respective embodiments of the scraper 1.

According to the embodiment illustrated in FIG. 7, the asbestos thus scraped scatters in the tangential direction thereof. Therefore, a raised portion 16 is formed so as to completely collect the scattering asbestos.

FIG. 1 is a flow chart according to the present invention. FIG. 2 is a front view of the device according to the present invention and FIG. 3 is a plan view showing one embodiment of said device, wherein said device is loaded on a truck.

Hereinafter the process of the present invention will be described with reference to FIG. 1. As illustrated in FIG. 1, said process comprises a preliminary cleaning process and cutting process at a work field, then a primary collecting process by means of a collector, then a secondary collecting process by means of a cyclone, then a tertiary collecting process by means of a scrubber, and then a final dust removing process by means of a compound filter to exhaust. Through said secondary and tertiary processes, a closed process to a carrier container, then to another carrier container, and then a carrying-in process to a final disposable lot are carried out.

Figure 3:
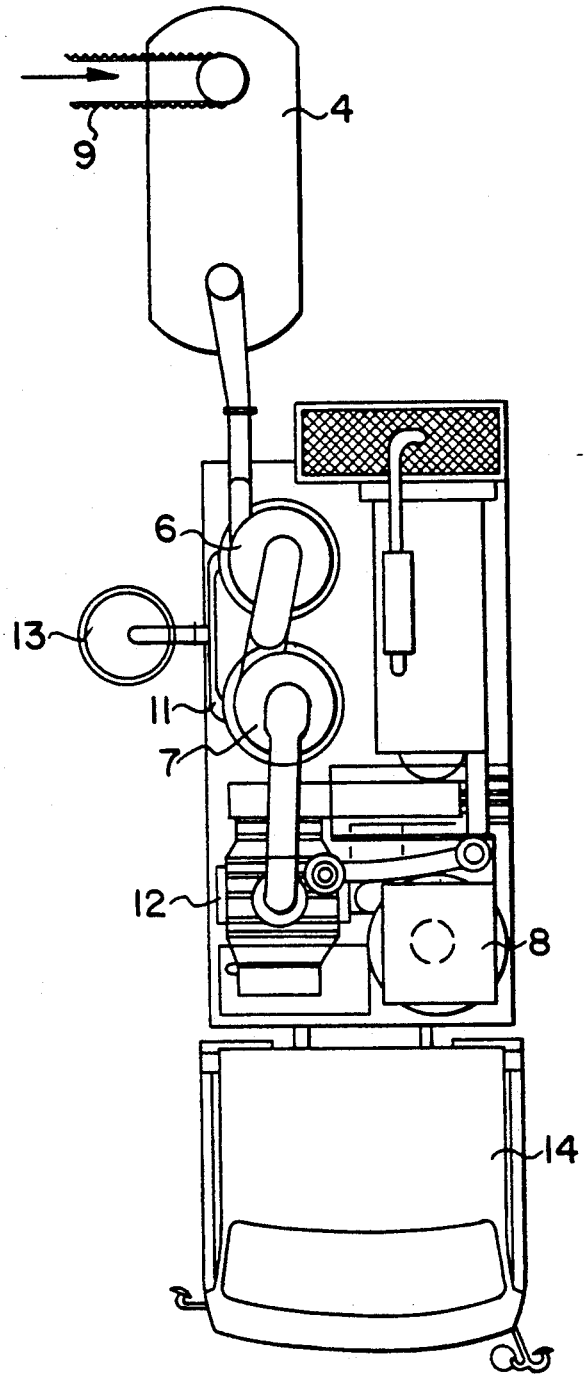
FIG. 3 is a plan view of said device, wherein said device is loaded onto a truck.
Figure 4:
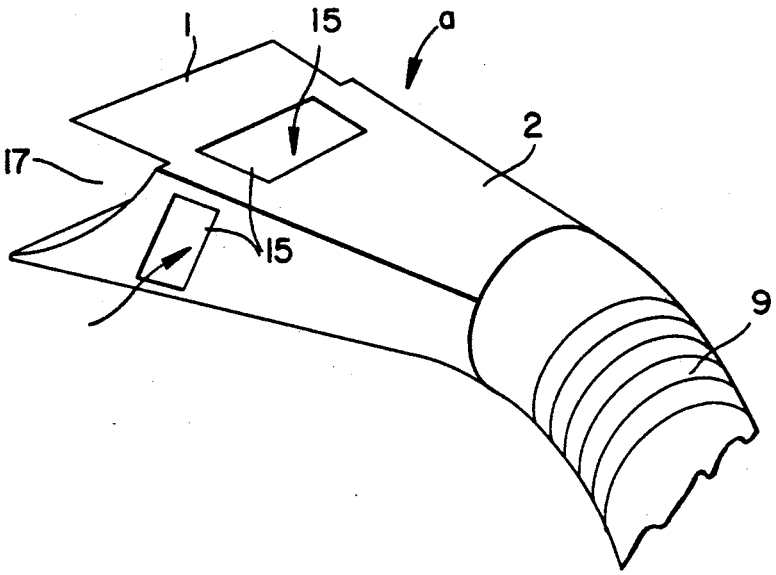
FIG. 4 is a perspective view of a first embodiment of an attachment applied to the device according to the present invention.
Figure 5:
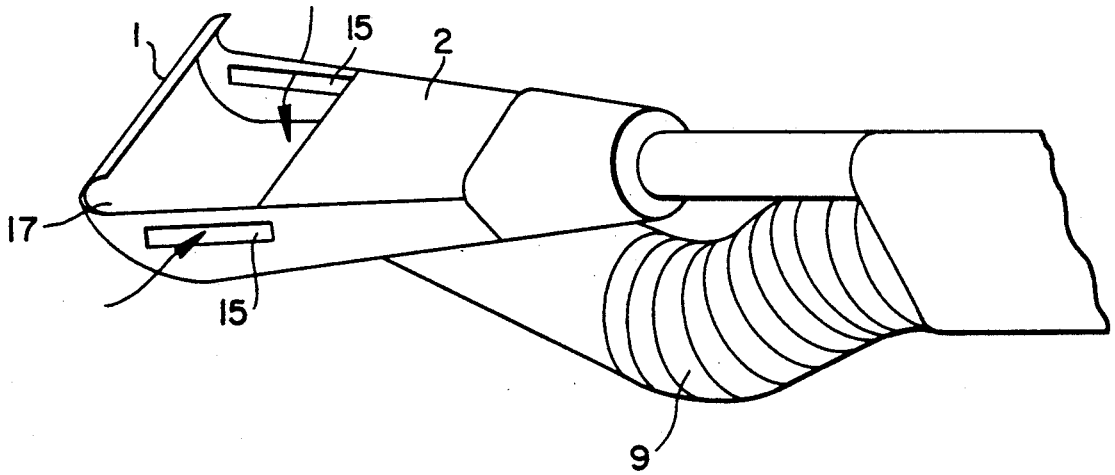
FIG. 5 is a perspective view of a second embodiment of an attachment applied to the device according to the present invention.

As illustrated in FIG. 2 and FIG. 3, the asbestos layer A sprayed onto the wall surface of a ceiling, etc. is scraped by means of the scraper 1 and suctioned through the suction air duct 2. The asbestos thus scraped together with the dust thereof are collected into the collector 4 through the air duct 2 and hose 9. Said collector 4 stores water 10 therewithin and an end portion of said hose 9 is open within said water 10. Accordingly, the dust of the asbestos is collected within water 10 (Primary collecting process).

The air passing through said collector 4 is let into a wet-type cyclone 6 through a closed conduit 3. Within said cyclone 6, a shower 5 is mounted so as to shower the inside of said cyclone (Secondary collecting process). Next, the air passing through the cyclone 6 is led into a scrubber 7 through the other closed conduit 3. The other shower 5 is also mounted within scrubber 7 so as to shower the inside of said scrubber 7 (Tertiary collecting process).

The air passing through said scrubber 7 is exhausted through another closed conduit 3 and further through a compound filter 8. Said compound filter 8 consists of a high efficiency filter 8*a*, a filter 8*b* and a pre-filter 8*c*. In the Figures, reference numeral 11 denotes a pipe (P) connecting to a carrier container 13. Reference numeral 12 denotes a blower and reference numeral 14 denotes a truck. In the above embodiment, the device according to the present invention is loaded onto a truck 14. Accordingly, it is possible to move the device easily to a work field so as to carry out the aforementioned primary, secondary and tertiary collecting processes, thereby finally obtaining clean air through the compound filter.

Furthermore, it is possible to apply the device and process to local demolition work in connection with partial repairs of a building, scavenging operation of a road, or cleaning of a construction, for the removal of the asbestos as described above.

Thus, according to the present invention, it is possible to collect the scraped asbestos together with the dust thereof simultaneously with cutting an asbestos layer by means of the scraper. It is further possible to collect floating asbestos through the apertures perforated in the suction air duct. Therefore, a collecting process of the asbestos becomes effective and further a face shift of the attachment becomes easy. Still furthermore, according to the present invention, asbestos dust concentration during the operation can be considerably reduced compared with that of the conventional technique, thereby improving the sanitary environment of those who are engaged in removing asbestos sprayed onto the ceiling, etc. At the same time, it is possible to improve operation efficiency and also reduee operation costs thereof.

I claim:

1. A process for removing a sprayed asbestos layer from a surface, comprising:

simultaneously cutting and suctioning asbestos by a scraper and a suction air duct;

directing the thus-suctioned asbestos into a collector through a closed conduit to collect asbestos dust within water as a primary collecting step;

carrying out a secondary collecting step in a wet cyclone by showering, in said cyclone, air that has passed through said collector to effect separation of asbestos out of said air; and then carrying out a tertiary collecting step to treat, with a scrubber and a compound filter, air that has passed through said cyclone.

2. A device for removing a sprayed asbestos layer comprising:

an attachment comprising a scraper integrally formed with a suction air duct which is provided with a plurality of apertures perforated therein and with a suction inlet, a closed conduit connected to said air duct through a hose, for carrying asbestos dust thus suctioned, a collector, said collector connected to a wet cyclone, and said wet cyclone connected to a scrubber within said closed conduit, and a compound filter disposed at an end of said closed conduit.

3. The device of claim 2, wherein said scraper is upwardly bent at an upper end thereof so as to provided scraping means.

4. The device of claim 2 wherein said suction air duct is provided with said plurality of apertures at a prescribed position in a vicinity of said suction inlet of said air duct.

5. The device of claim 2 wherein said suction air duct is provided with a raised portion formed at an upper end thereof to collect scattering asbestos.

6. The device of claim 2 wherein a rotary electric brush is provided inside said suction inlet.

* * * * *